United States Patent [19]

Bröker

[11] 4,102,611

[45] Jul. 25, 1978

[54] PLUNGER PUMP

[75] Inventor: Erich Bröker, Oelde, Fed. Rep. of Germany

[73] Assignee: Paul Hammelmann Maschinenfabrik, Oelde, Fed. Rep. of Germany

[21] Appl. No.: 785,730

[22] Filed: Apr. 11, 1977

[30] Foreign Application Priority Data

Apr. 9, 1976 [DE] Fed. Rep. of Germany ..... 2615530

[51] Int. Cl.[2] ..... F04B 21/02; F04B 39/10

[52] U.S. Cl. ..... 417/469; 417/559; 417/457

[58] Field of Search ..... 417/469, 457, 559

[56] References Cited

FOREIGN PATENT DOCUMENTS

| | | | |
|---|---|---|---|
| 2,411,546 | 9/1975 | Fed. Rep. of Germany | 417/457 |
| 1,462,145 | 1/1977 | United Kingdom | 417/469 |

*Primary Examiner*—William L. Freeh
*Attorney, Agent, or Firm*—Michael J. Striker

[57] ABSTRACT

A plunger pump has a pump housing defining a pumping chamber into which a plunger extends for reciprocation between a retracted and an extended position. A sleeve valve is mounted on the plunger for displacement longitudinally thereof and for limited reciprocation therewith between an open position and a closed position in which it subdivides the pumping chamber into a pumping space within, and a suction space without, the sleeve valve. Inlet and outlet ports communicate with the suction and pumping spaces respectively. A sealing sleeve is mounted on a portion of reduced diameter of the plunger and defines with the latter a compensating space which communicates with a region of the interface between the sleeve valve and sealing sleeve at which the pressure of the fluid escaping from the pumping space through the interface is lower than the pumping pressure existing in the pumping space during the pumping stroke of the plunger. Thus, the pressure of the escaping liquid and the pressure in the compensating space deform the sealing sleeve into sealing contact with the internal surface of the sleeve valve. The sealing sleeve is sealingly mounted on two lands of the reduced portion of the plunger and is connected to the latter by a disk and a nut threadingly mounted on a threaded pin rigid with the plunger.

11 Claims, 2 Drawing Figures

PLUNGER PUMP

BACKGROUND OF THE INVENTION

The present invention relates to pumps in general, and more particularly to plunger-type pumps.

There are already known and in widespread use various constructions of pumps which, depending on the requirements of such pumps, such as the pressure conditions, types of media to be pumped, volume to be pumped, and whether the operation is to be intermittent or continuous, have different shapes and operating parameters. Among such pumps, there has been already proposed a plunger-type pump in which a plunger is mounted in a pump housing and extends into a pumping chamber defined by the latter for reciprocation therein. In a pump of this type, one-way valves are to be provided both at the inlet side and on the outlet side of the pump and, in this connection, it has already been proposed to construct the inlet valve as a valve sleeve which is mounted on the plunger for movement longitudinally thereof and for limited reciprocation therewith. Then, the sleeve valve subdivides the pumping chamber into a suction space and a pumping space, the former surrounding, and the latter being located within the sleeve valve.

Pumps of the latter type achieve excellent results while being simple. However, experience with this type of pumps has shown that the seaing of the interface between the sleeve valve and the plunger leaves much to be desired. Usually, such a seal is constructed as an interface seal and is achieved by selecting the proper tolerance between the inner surface of the valve sleeve and the outer surface of the plunger, and by properly selecting the materials of the two components which bound the interface. While, under many circumstances, this type of seal may work to satisfaction, it has been established that this type of seal cannot be used with certain media to be pumped, particularly with aggressive media. A further limitation to the use of this type of seal resides in the fact that this type of seal can only be used up to a certain pressure existing in the pumping chamber. While it is not absolutely impossible to properly select the tolerances between the abovementioned surfaces for any pressure region or pressure differential existing across the sleeve valve, it has been found that the high precision which is required for high pressure involves costs which are prohibitive.

SUMMARY OF THE INVENTION

Accordingly, it is a general object of the present invention to avoid the disadvantages of the prior art.

More particularly it is an object of the present invention to provide a plunger-type pump which is not possessed of the above-discussed disadvantages of the prior-art plunger pumps.

It is a further object of the present invention to so construct the plunger pump that the interface seal between the plunger and the sleeve valve is capable of providing sufficient seal even at very high pressures existing in the pumping space.

A concomitant object of the present invention is to provide a pump which is simple in construction, inexpensive to manufacture, and reliable in operation.

In pursuance of these objects and others which will become apparent hereafter, one feature of the present invention resides, briefly stated, in a plunger pump comprising, in combination, a pump housing having a pumping chamber and an end wall; an elongated plunger mounted in said pump housing for reciprocation longitudinally thereof between a retracted and an extended position, at least partly received in said pumping chamber, and having a free end facing said end wall, a first portion longitudinally spaced from said free end and having an external surface, and a second portion extending from said first portion to said free end and having an outer surface inwardly offset from said external surface; a sleeve valve mounted on said plunger for displacement longitudinally thereof and for limited reciprocation therewith between an open and a closed position in which said sleeve valve is spaced from, and in sealing contact with, said end wall, respectively, said sleeve valve, when in said closing position, subdividing said pumping chamber into a pressure space within, and a suction space around, said sleeve valve and having an internal surface in sealing contact with said external surface of said plunger; means for admitting a fluid into said suction space; means for discharging the fluid from said pressure space; and means for sealing said pressure chamber with respect to said suction chamber, including a sealing sleeve surrounding said second portion of said plunger and having an outer contact surface juxtaposed with said internal surface of said sleeve valve and an inner surface bounding with said outer surface of said second portion of said plunger an annular compensating space, and means for maintaining a body of fluid in said compensating space at a compensating pressure sufficient to press said contact surface of said sealing sleeve into sealing contact with said internal surface of said sleeve valve. When constructed in this manner, the plunger, during the movement thereof from the retracted toward the extended position and with the sleeve valve in the closed position thereof, elevates the pressure of the fluid in the pumping chamber from a suction pressure to a pumping pressure, and the compensating pressure is then below such pumping pressure but above the above-mentioned suction pressure. The fluid penetrates from the pumping chamber into the interface between said contact, external and internal surface and the pressure thereof decreases along said plunger ffrom said free end thereof; then, the maintaining means preferably includes a duct communicating said compensating space with a region of said interface which is at said compensating pressure.

It will be appreciated that, when the plunger pump is constructed according to the present invention, the tolerance between the plunger and the sleeve valve depends on the pumping pressure prevailing in the pumping space and, in fact, is controlled by the pumping pressure existing in the region of the free end of the plunger and the portion of the sleeve valve which surrounds such free end portion.

When the pumping pressure is low, the tolerance between the above-mentioned surfaces which has been achieved by machining the respective surfaces, is adjusted only to a small extent, whereas the sealing sleeve which is mounted on the second portion of the plunger is conically deformed at high and very high pumping pressure due to the pressure differential between the pressure existing in the interface between the sleeve valve and the sealing sleeve, and the compensating pressure existing in the annular space between the sealing sleeve and the second portion of the plunger. As a result of this, a wedge-shaped gap forms between the sleeve valve and the sealing sleeve which is mounted on the second portion of the plunger, and the various pressures acting on the sealing sleeve counteract each other and cause centering of the sleeve valve relative to the plunger. A relatively large tolerance field is bridged as the result of the conical widening of the sealing sleeve which is mounted on the second portion of the plunger.

The sealing sleeve is preferably elongated and has a longitudinally central zone, and the above-mentioned duct may be provided at the central zone, frontwardly thereof, or rearwardly thereof,, as considered longitudinally of the plunger.

In a currently preferred embodiment of the present invention, the maintaining means includes means for fluidtightly sealing the compensating space at the end portions of the sealing sleeve. Advantageously, the above-mentioned second portion of the plunger has a recess constituting said compensating chamber, and two longitudinally spaced lands having the above-mentioned outer surface and longitudinally delimiting said recess; then, the sealing sleeve has respective end faces at the respective end portions thereof, and the fluidtightly sealing means includes two annular grooves each opening onto one of said end faces and onto said inner surface of said sealing sleeve, and two annular seals each received in one of said grooves and sealingly contacting one of said lands.

In an advantageous embodiment of the present invention, there is provided means for connecting said sealing sleeve to said plunger, including a threaded pin rigid with said plunger and extending longitudinally beyond said free end of the latter, a nut threadingly mounted on said threaded pin; and a disk interposed between said nut and said sealing sleeve.

The pump of the present invention advantageously comprises means for urging said sleeve valve toward said closed position thereof, and means for limiting the extent of reciprocation of said sleeve valve with said plunger.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DISCUSSION OF THE PREFERRED EMBODIMENTS

Figure 1:
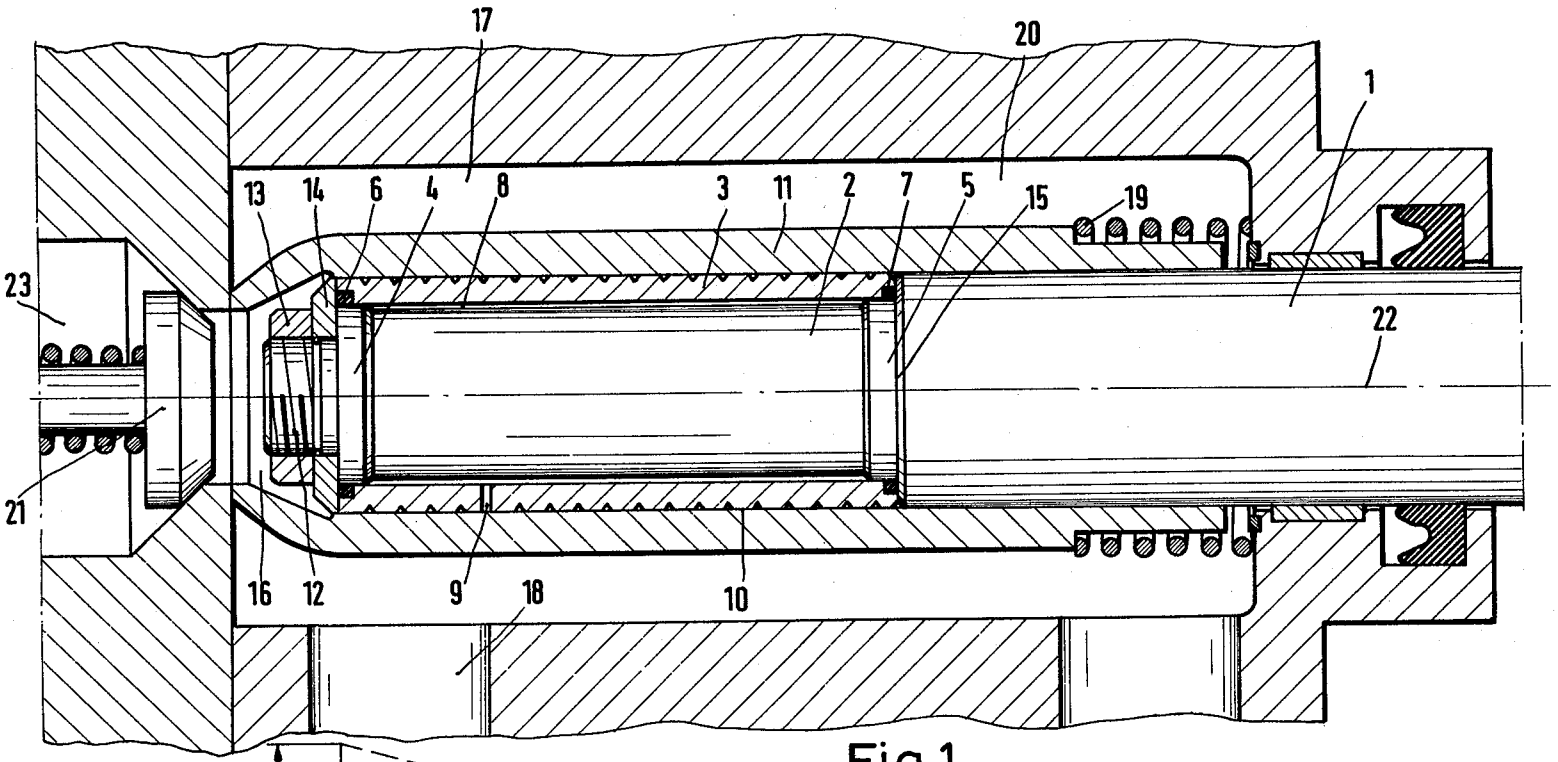
FIG. 1 is a sectional view of a plunger pump of the present invention.

Referring now to the drawing in detail, and first of FIG. 1 thereof, it may be seen that it illustrates a plunger pump, particularly a high-pressure plunger pump which includes a plunger 1 which has a free end portion 2 having a reduced diameter with respet to the remainder of the plunger 1. The front end 2 of the plunger 1 is surrounded by a sealing sleeve 3 which, at its front and rear end, is supported on a land 4, 5 of the plunger 1 and is fluidtightly sealed relative to the plunger 1 by sealing rings 6, 7. The sealing rings 6, 7 are accommodated in grooves of the sealing sleeve 3, which are open on the respective end faces, and inwardly of, the sealing sleeve 3.

The front end 2 of the plunger 1 has a recess 8 of a reduced diameter relative to the lands 4, 5, so that the sealing sleeve 3 and the front end 2 of the plunger 1 with the recess 8 therein constitute a compensating chamber which is connected, via a bore or duct 9, with an interface 10 which exists, based on the chosen tolerances, between the plunger 1 and a sleeve valve 11 which is slidingly mounted on the plunger 1.

The plunger 1 is provided, at its front end, with a threaded pin 12 on which there is threadingly mounted a nut 13 serving for connecting a disk 14 to the plunger 1. The disk 14 abuts the free end of the sealing sleeve 3 and thus secures the latter in its relative position with respect to the plunger 1. The sealing sleeve 3 abuts, at its rear end, against an abutment surface 15 of the plunger 1.

The sleeve valve 11 subdivides, when in its closed position, the pressure chamber of the housing of the pump, into a pressure space 16 radially outwardly surrounded by the sleeve valve 11, and a suction space 17 which surrounds the front end of the sleeve valve 11. A fluid medium to be pumped is introduced into the suction space 17 of the pump through a conduit or port 18.

A spring 19 is provided in the interior of the housing of the pump, being associated with the sleeve valve 11 in such a manner that the compression spring 19 abuts, at one of its ends, against the pump housing and, at its other end, against a shoulder of the sleeve valve 11.

Figure 2:
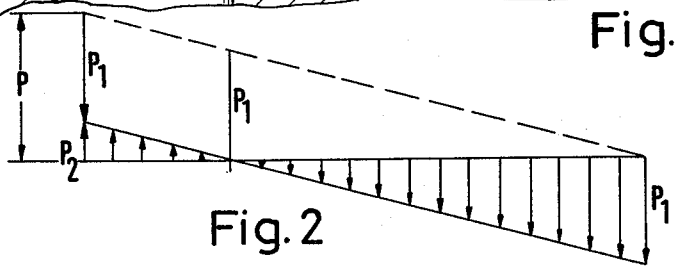
FIG. 2 is a force diagram illustrating the forces which act on the sealing sleeve of FIG. 1.

Referring now also to FIG. 2, it may be seen that the working or pumping pressure P prevailing in the pressure space 16 of the pump during the pumping stroke of the plunger 1, exists at the front end of the annular gap 10 but gradually decreases from such front end to the rear end of such annular gap 10.. This reduction in pressure is indicated in FIG. 2 by a broken line. As a result of the presence of the duct 9, the compensating pressure in the compensating space 8 will be at the valve $P_1$, which pressure $P_1$ acts on the sealing sleeve 3 opposite to the action of the pressure existing in the annular gap 10. It follows from the pressure diagram of FIG. 2 that a resulting pressure $P_2$ acts on the front end of the sealing sleeve 3, which pressure $P_2$ acts on the sealing sleeve 3 radially inwardly and has a tendency to compress the sealing sleeve 3 at its front end. Beyond the connecting duct 9, there exist resulting pressures which act on the sealing sleeve 3 in the radially outward directions and have the tendency to expand the sealing sleeve 3. As a result of this, the sealing sleeve 3 is conically deformed. The intensity of this deformation depends, on the one hand, on the thickness of the walls of the sealing sleeve 3 and, on the other hand, also on the selection of the material of the sealing sleeve 3. In addition thereto, the extent of deformation will be determined by the position of the connecting bore or duct 9.

In the embodiment of the present invention illustrated in FIG. 1, the connecting bore 9 is provided in the front half or, actually, in the front third of the sealing sleeve 3. However, there also exists the possibility to provide the connecting bore 9 in the central region of the sealing sleeve 3 or in the rear half of the sealing sleeve 3.

The sealing sleeve 3 and its mounting on the plunger 1 are so constructed that the sealing sleeve 3 can be reversed in its position on the front portion 2 of the plunger 1. The reason for this is that, as a result of the conical expansion of the sealing sleeve 3, the extent of wear will be the greatest in the region of the greatest expansion of the sealing sleeve 3 during the operation of the plunger pump of the present invention. As a result of the reversal of the sealing sleeve 3, the zone of the sealing sleeve 3 which has been previously subjected to the greatest wear, now will be located in a region of minimal or no wear, so that a very long lifespan of the sealing sleeve 3 is obtained by this simple expedient.

The high-pressure plunger pump illustrated in FIG. 1 is provided with a one-way valve 21 which, as illustrated, is coaxial with the central axis 22 of the pump. The medium being pumped is expelled by the plunger 1 from the pumping space 16 of the pump through the open valve 21 into a space 23, from where it is delivered into a nonillustrated discharge conduit.

It will be understood that each of the elements described above, or two or more together, may also find a useful application in other types of constructions differing from the types described above.

While the invention has been illustrated and described as embodied in a plunger-type pump, it is not intended to be limited to the details shown, since various modifictions and structural changes may be made without departing in any way from the spirit of the present invention.

Without further analysis, the foregoing will so fully reveal the gist of the present invention that others can, by applying current knowledge, readily adapt it for various applications without omitted features that, from the standpoint of prior art, fairly constitute essential characteristics of the generic or specific aspects of this invention.

What is claimed as new and desired to be protected by Letters Patent is set forth in the appended claims.

1. A plunger pump comprising, in combination, a pump housing having a pumping chamber and an end wall; an elongated plunger mounted in said pump housing for reciprocation longitudinally thereof between a retracted and an extended position, at least partly received in said pumping chamber, and having a free end facing said end wall, a first portion longitudinally spaced from said free end and having an external surface, and a second portion extending from said first portion of said free end and having an outer surface inwardly offset from said external surface; a sleeve valve mounted on said plunger for displacement longitudinally thereof and for limited reciprocation therewith between an open and a closed position in which said sleeve valve is spaced from, and in sealing contact with, said end wall, respectively, said sleeve valve, when in said closed position, subdividing said pumping chamber into a pressure space within, and a suction space around, said sleeve valve and having an internal surface in sealing contact with said external surface of said plunger; means for admitting a fluid into said suction space; means for discharging the fluid from said pressure space; and means for sealing said pressure chamber with respect to said suction chamber, including a sealing sleeve surrounding said second portion of said plunger and having an outer contact surface juxtaposed with said internal surface of said sleeve valve and an inner surface bounding with said outer surface of said second portion of said plunger an annular compensating space, and means for maintaining a body of fluid in said compensating space at a compensating pressure sufficient to press said contact surface of said sealing sleeve into sealing contact with said internal surface of said sleeve valve.

2. A combination as defined in claim 1, and further comprising means for connecting said sealing sleeve to said plunger, including a threaded pin rigid with said plunger and extending longitudinally beyond said free end of the latter, a nut threadingly mounted on said threaded pin; and a disk interposed between said nut and said sealing sleeve.

3. A combination as defined in claim 1; and further comprising means for urging said sleeve valve toward said closed position thereof.

4. A combination as defined in claim 1, and further comprising means for limiting the extent of reciprocation of said sleeve valve with said plunger.

5. A combination as defined in claim 1, wherein said plunger, during the movement thereof from said retracted toward said extended position and with said sleeve valve in said closed position, elevates the pressure of the fluid in said pumping chamber from a suction pressure to a pumping pressure; and wherein said compensating pressure of said fluid body in said compensating space is below said pumping pressure but above said suction pressure.

6. A combination as defined in claim 5, wherein the fluid penetrates from said pumping chamber into the interface between said contact, external and internal surface and the pressure thereof decreases along said plunger from said free end thereof; and wherein said maintaining means includes a duct communicating said compensating space with a region of said interface which is at said compensating pressure.

7. A combination as defined in claim 6, wherein said sealing sleeve is elongated and has a longitudinally central zone; and wherein said region is at said central zone.

8. A combination as defined in claim 6, wherein said sealing sleeve is elongated and has an end portion remote from said pumping chamber; and wherein said region is at said end portion.

9. A combination as defined in claim 6, wherein said sealing sleeve is elongated and has an end portion close to said pumping chamber; and wherein said region is at said end portion.

10. A combination as defined in claim 1, wherein said sealing sleeve is elongated and has longitudinally spaced end portions; and wherein said maintaining means includes means for fluid-tightly sealing said compensating space at said end portions.

11. A combination as defined in claim 10, wherein said second portion of said plunger has a recess constituting said compensating chamber and two longitudinally spaced lands having said outer surface and longitudinally delimiting said recess; wherein said sealing sleeve has respective end faces at the respective end portions thereof; and wherein said fluid-tightly sealing means includes two annular grooves each opening onto one of said end faces and onto said inner surface of said sealing sleeve, and two annular seals each received in one of said grooves and sealingly contacting one of said lands.

* * * * *